US006110572A

United States Patent [19]

Groh et al.

[11] Patent Number: 6,110,572

[45] **Date of Patent: *Aug. 29, 2000**

[54] BASE INLINER WITH IMPROVED LOADBEARING REINFORCEMENT AT LOW ELONGATION AT AMBIENT TEMPERATURE

[75] Inventors: Werner Groh, Schwabmünchen; Hans-Jürgen Profé, Bobingen; Michael Schöps, Grossaitingen, all of Germany

[73] Assignee: Johns Marville International, Inc., Denver, Colo.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/853,316

[22] Filed: May 8, 1997

[30] Foreign Application Priority Data

May 10, 1996 [DE] Germany ..... 196 20 361

[51] Int. Cl.[7] ..... D04H 1/74

[52] U.S. Cl. ..... 428/219; 428/332; 428/902; 442/334; 442/366; 442/367; 442/368; 442/401; 442/414

[58] Field of Search ..... 442/13, 35, 48, 442/52, 57, 229, 269, 302, 305, 320, 366, 367, 368, 377, 414; 428/902, 332, 219

[56] References Cited

U.S. PATENT DOCUMENTS

| | | |
|---|---|---|
| 4,987,027 | 1/1991 | Zerfass et al. . |
| 5,118,550 | 6/1992 | Baravian et al. . |
| 5,612,114 | 3/1997 | Zalewski et al. . |

FOREIGN PATENT DOCUMENTS

| | | |
|---|---|---|
| 359165 | 3/1990 | European Pat. Off. . |
| 9207367 | 9/1902 | Germany . |
| 3941189 | 6/1990 | Germany . |
| 4337984 | 5/1995 | Germany . |

*Primary Examiner*—Elizabeth M. Cole
*Attorney, Agent, or Firm*—Burns, Doane, Swecker & Mathis, L.L.P.

[57] ABSTRACT

Disclosed is a base inliner comprising a textile sheet material and a reinforcement, wherein said reinforcement comprises monofilaments whose diameter is at least 0.1 mm, preferably between 0.1 and 1 mm. The base inliner is useful for producing optionally bituminized roofing and sealing membranes.

19 Claims, No Drawings

BASE INLINER WITH IMPROVED LOADBEARING REINFORCEMENT AT LOW ELONGATION AT AMBIENT TEMPERATURE

The invention relates to a base inliner which is especially useful as base inliner for producing roofing membranes or as tarpaulin or sheet.

Base inliners for roofing membranes have to meet a wide variety of requirements. First, for instance, there is a need for adequate mechanical stability, such as good perforation resistance and good tensile strength, to withstand, for example, the mechanical stresses of further processing, such as bituminization or laying. In addition, there is a need for high resistance to thermal stress, for example the thermal stress of bituminization, radiant heat and flying brands. There has therefore been no shortage of attempts to improve existing base inliners.

For instance, it is already known to combine nonwovens based on synthetic fiber webs with reinforcing fibers, for example with glass fibers. Examples of such sealing membranes may be found in GB-A-1,517,595, DE-U-77-39,489, EP-A-160,609, EP-A-176-847, EP-A-403,403 and EP-A-530,769. The fiber web and reinforcing fibers are joined together in this art either by adhering by means of a binder or by needling together the layers composed of different materials.

It is further known to produce composite materials by knitting or sew-knit techniques. Examples thereof may be found in DE-A-3,347,280, U.S. Pat. No. 4,472,086, EP-A-333,602 and EP-A-395,548.

DE-A-3,417,517 discloses a textile interlining having anisotropic properties and a process for producing it. The interlining consists of a substrate which has a surface that melts below 150° C. and reinforcing filaments that melt at above 180° C., which are fixed to the surface in a parallel arrangement. In one embodiment, the substrate can be a nonwoven supporting, on one of its surfaces, fusible adhesive fibers or filaments provided for producing an adhesive bond between the parallel reinforcing fibers and the nonwoven.

U.S. Pat. No. 4,504,539 discloses a combination of reinforcing fibers in the form of bicomponent fibers with nonwovens based on synthetic fibers.

EP-A-0,281,643 discloses a combination of reinforcing fibers in the form of a network of bicomponent fibers with nonwovens based on synthetic fibers, wherein the weight proportion of the network of bicomponent fibers is at least 15% by weight.

JP-A-81-5879 discloses a composite provided with a netlike reinforcing material.

GB-A-2,017,180 discloses a filter material composed of inorganic web material and metal wires, which is used for waste air cleaning at high temperatures (higher than 300° C.).

DE-U-295 00 830 describes the reinforcement of a glass web with synthetic monofils. These reinforcing monofils do not contribute significantly to the load at low elongations in the sealing membrane. However, they have a distinctly higher ultimate tensile stress extension than the glass web; thus, the sheetlike integrity of the sealing membrane is ensured even in the event of deformations which can lead to the rupture of the glass web. The shrinkage of the synthetic monofils is higher than the shrinkage of the glass web and can lead to waviness in the sealing membrane.

DE-A-3,941,189 likewise discloses a combination of reinforcing fibers in the form of a yarn warp with nonwovens based on synthetic fibers, which can be joined together in a wide variety of ways. A preferred joining technique is needling. With needling there is a risk of damaging or breaking the reinforcing threads.

Said reference tries to solve this problem by means of a special orientation of the needles. However, under manufacturing conditions, this ideal orientation of needles with respect to reinforcing threads is not always assured.

It is an object of the present invention to develop a base inliner which has an excellent mechanical requirement profile, for example a high modulus at low elongations and at room temperature. This object is solved by using monofils whose diameter is greater than the kick-up of the needles. The monofil reinforcement of this invention leads to particularly low values of the strain reserve; these monofils or sheet materials produced therefrom are intrinsically stiff, making them particularly suitable for their being provided, and incorporated into the base inliner, in the oriented state. Unlike multifilaments, they always act loadbearingly over their entire cross section. The diameter of the monofils is preferably greater than the sum total of needle kick-up and barb depth. The diameter of the monofilaments used is customarily at least 0.1 mm.

The present invention accordingly provides a base inliner comprising a textile sheet material and a reinforcement, wherein said reinforcement comprises monofilaments whose diameter is at least 0.1 mm, preferably between 0.1 and 1 mm, particularly preferably 0.1–0.5 mm, especially preferably 0.1–0.3 mm.

Such base inliners can absorb a force so that, in a stress-strain diagram (at 20° C.), the load at an elongation within the range between 0 and 1% differs by at least 10%, preferably by at least 20%, particularly preferably by at least 30%, at at least one location for said base inliner with reinforcement compared with said base inliner without reinforcement.

The term "textile sheet material" is herein used in its widest sense. It encompasses all structures formed from synthesized polymer fibers by a sheet-forming technique.

The terms "barb depth" and "kick-up" are defined in Groz-Beckert's 1994 brochure entitled "Felting Needles".

The load at stated elongation is measured in accordance with EN 29073 Part 3 on specimens 5 cm in width using a measuring length of 100 mm. The numerical value of the pretensioning force in centinewtons corresponds to the numerical value of the basis weight of the specimen in grams per square meter.

Examples of such textile sheet materials are wovens, lays, knits and, preferably, webs.

Of the webs composed of fibers composed of synthetic polymers, spunbonded webs, spunbonds, which are produced by random laydown of freshly melt-spun filaments, are preferred. They consist of continuous filament synthetic fibers composed of melt-spinnable polymer materials. Suitable polymer materials include for example polyamides, e.g. polyhexamethylenediadipamide, polycaprolactam, wholly or partly aromatic polyamides ("aramids"), aliphatic polyamides, e.g. nylon, partly or wholly aromatic polyesters, polyphenylene sulfide (PPS), polymers having ether and keto groups, e.g. polyetherketones (PEKs) and polyetheretherketone (PEEK), or polybenzimidazoles.

The spunbonded webs preferably consist of melt-spinnable polyesters. The polyester material can in principle be any known type suitable for fibermaking. Such polyesters consist predominantly of building blocks derived from aromatic dicarboxylic acids and from aliphatic diols. Commonly used aromatic dicarboxylic acid building blocks are the bivalent radicals of benzenedicarboxylic acids, especially of terephthalic acid and of isophthalic acid; commonly used diols have 2 to 4 carbon atoms, and ethylene glycol is particularly suitable. Spunbonded webs which are at least 85 mol % polyethylene terephthalate are particularly advantageous. The remaining 15 mol % are then composed of dicarboxylic acid units and glycol units, which act as modifiers, socalled, and which enable the person skilled in the art to adjust the physical and chemical properties of the product filaments in a specific manner. Examples of such dicarboxylic acid units are the radicals of isophthalic acid or of aliphatic dicarboxylic acid such as, for example, glutaric acid, adipic acid, sebacic acid; examples of modifying diol radicals are those of diols having longer chains, for example of propanediol or butanediol, of di- or triethylene glycol or, if present in a small amount, of polyglycol having a molecular weight of about 500 to 2000.

Particular preference is given to polyesters comprising at least 95 mol % of polyethylene terephthalate (PET), especially those composed of unmodified PET.

If the base inliners of the invention are additionally to have a flame-retardant effect, it is advantageous to spin them from polyesters which have been modified to be flame-retardant. Such flame-retardant modified polyesters are known. They comprise additions of halogen compounds, especially bromine compounds, or, particularly advantageously, contain phosphorus compounds incorporated into the polyester backbone by cocondensation.

The spunbonded webs particularly preferably comprise flame-retardant modified polyesters containing, cocondensed into the backbone, units of the formula (I)

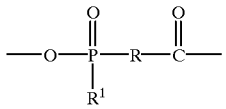

(I)

where R is alkylene or polymethylene having 2 to 6 carbon atoms or phenyl and $R^1$ is alkyl having 1 to 6 carbon atoms, aryl or aralkyl. Preferably, in the formula (I), R is ethylene and $R^1$ is methyl, ethyl, phenyl or o-, m- or p-methylphenyl, especially methyl. Such spunbonded webs are described in DE-A-39 40 713, for example.

The polyesters in the spunbonded web preferably have a molecular weight corresponding to an intrinsic viscosity (IV) of 0.6 to 1.4, measured in a solution of 1 g of polymer in 100 ml of dichloroacetic acid at 25° C.

The polyester filaments in the spunbonded web have filament linear densities between 1 and 16 dtex, preferably 2 to 8 dtex.

In a further embodiment of the invention, the spunbonded web can also be a nonwoven which has been consolidated by means of a fusible binder, said nonwoven comprising loadbearing and fusible adhesive fibers. The loadbearing and fusible adhesive fibers can be derived from any desired thermoplastic fiber-forming polymers. Loadbearing fibers may in addition also be derived from nonmelting fiber-forming polymers. Such fusible binder consolidated spunbonds are described for example in EP-A-0,446,822 and EP-A-0,590,629.

Examples of polymers from which the loadbearing fibers can be derived are polyacrylonitrile, polyolefins, such as polyethylene, essentially aliphatic polyamides, such as nylon-6,6, essentially aromatic polyamides (aramids), such as poly(p-phenyleneterephthalamide) or copolymers containing a proportion of aromatic m-diamine units to improve the solubility or poly(m-phenyleneisophthalamide), essentially aromatic polyesters, such as poly(p-hydroxybenzoate) or preferably essentially aliphatic polyesters, such as polyethylene terephthalate.

The relative proportions of the two fiber types can be chosen within wide limits, although care has to be taken to ensure that the proportion of the fusible adhesive fibers is sufficiently high for the nonwoven to acquire a strength which is sufficient for the desired application as a result of the loadbearing fibers being adhered together by the fusible adhesive fibers. The proportion in the nonwoven of fusible adhesive due to the fusible adhesive fiber is customarily less than 50% by weight, based on the weight of the nonwoven.

Suitable fusible adhesives include in particular modified polyesters having a melting point which is 10 to 50° C., preferably 30 to 50° C., lower than that of the nonwoven raw material. Examples of such fusible adhesive are polypropylene, polybutylene terephthalate, and polyethylene terephthalate modified through incorporative cocondensation of longer-chain diols and/or of isophthalic acid or aliphatic dicarboxylic acids.

The fusible adhesives are preferably introduced into the webs in fiber form.

Loadbearing and fusible adhesive fibers are preferably composed of the same class of polymer. This is to be understood as meaning that all the fibers used are selected from the same class of substances so that they can be readily recycled after use of the web. If the loadbearing fibers consist of polyester, for example, the fusible adhesive fibers are likewise made of polyester or of a mixture of polyesters, for example as bicomponent fiber with PET in the core and a lower melting polyethylene terephthalate copolymer as sheath. In addition, however, it is also possible to use bicomponent fibers constructed from different polymers. Examples are bicomponent fibers composed of polyester and polyamide (core/sheath).

The fiber linear densities of the loadbearing and the fusible adhesive fibers can be chosen within wide limits. Examples of customary linear density ranges are 1 to 16 dtex, preferably 2 to 6 dtex.

If the flame-retardant base inliners of the invention are additionally bonded, they preferably comprise flame-retardant fusible adhesives. An example of the form a flame-retardant fusible adhesive can take in the layered product of the invention is a polyethylene terephthalate modified by incorporation of chain members of the above-indicated formula (I).

The filaments or staple fibers of the nonwovens may have a virtually round cross-section or else another shape, such as dumbbell-shaped, kidney-shaped, triangular or tri- or multilobal cross-section. It is also possible to use hollow fibers. Furthermore, the fusible adhesive fiber can also be used in the form of bicomponent fibers or fibers constructed from more than two components.

The fibers of the textile sheet material may be modified by customary additives, for example by antistats, such as carbon black.

The basis weight of the spunbonded web is between 20 and 500 g/m$^2$, preferably 40 and 250 g/m$^2$.

The reinforcement used in the base inliner of this invention is such that it starts to absorb a force and transfer it at an elongation within the range from 0 to 1% (at ambient temperature 20° C.), so that, in the stress-strain diagram, the load at stated elongation increases by at least 10%, preferably by at least 20%, particularly preferably by at least 30%, compared with the unreinforced base inliner. In addition, the reinforcement is such that the ratio of the load at a stated elongation, measured at at least one point within the range between 0 and 1%, for the base inliner at room temperature (20° C.) to the base inliner at 180° C. is not more than 3 (three), preferably not more than 2.5, particularly preferably less than 2.

The foregoing properties are obtained by means of monofilaments whose Young's modulus is at least 5 Gpa, preferably at least 10 Gpa, particularly preferably at least 20 Gpa. The aforementioned monofilaments have a diameter between 0.1 and 1 mm, preferably 0.1 and 0.5 mm, in particular 0.1 and 0.3 mm, and possess a breaking extension of 0.5 to 100%, preferably 1 to 60%. The base inliners of the invention particularly advantageously have a strain reserve of less than 1%.

The strain reserve is the strain which acts on the base inliner before the load is transferred to the monofilaments; that is, a strain reserve of 0% would mean that tensile forces acting on the base inliner would immediately be transferred to the monofilaments. Consequently, forces acting on the spunbonded web do not first cause an alignment or orientation of the monofilaments, but are on the contrary directly transferred to the monofilaments, so that damage to the textile sheet material can be avoided. This shows itself in particular in a steep increase in the force to be applied at low elongations (stress-strain diagram at room temperature). In addition, the ultimate tensile stress extension of the base inliner can be appreciably improved by means of suitable monofilaments, which have a high breaking extension. Examples of suitable monofilaments are high tenacity monofilaments composed of polyester and wires composed of metals or metallic alloys whose breaking extension is at least 10%.

Preference is given to monofilaments based on aramids, preferably high modulus aramids, high tenacity polyester monofilaments and particularly preferably wires (monofilaments) composed of metals or metallic alloys.

Preferred reinforcements consist for economic reasons of metal monofilaments in the form of sheets of parallel ends or in the form of lays or wovens with or without other mono- or multifilaments.

Usually, the nonwovens are only reinforced in the longitudinal direction, by sheets of parallel ends.

The monofil reinforcement of this invention leads to particularly low values of the strain reserve; these monofils or sheet materials produced therefrom are intrinsically stiff, making them particularly suitable for their being provided, and incorporated into the base inliner, in the oriented state. Unlike multifilaments, they always act loadbearingly over their entire cross section.

The monofilaments are preferably provided during the formation of the spun bond and thus become embedded in the spun bond. The thread count can vary within wide limits as a function of the desired property profile. The thread count is preferably between 20 and 200 ends per meter. The thread count is measured perpendicularly to the running direction of the ends.

After production, the spunbonded webs are customarily subjected to chemical or thermal and/or mechanical consolidation in known manner. The spunbonded webs are preferably consolidated mechanically by needling. For this, the spunbonded web, which advantageously already comprises the monofilaments, is customarily needled using a needling density of 20 to 100 stitches/cm$^2$. The needling is advantageously effected by means of needles whose kick-up, preferably the sum total of kick-up and barb depth, is less than the diameter of the monofilaments. This prevents damage to the monofilaments. Subsequently, the spunbonded webs are subjected to further consolidation steps, for example to a thermal treatment.

For this, the spunbonded webs which, as well as load-bearing fibers, comprise fusible binding fibers are thermally consolidated in a conventional manner using a calender or in an oven.

If the spunbonded webs do not comprise binding fibers capable of thermal consolidation, these spunbonded webs are impregnated with a chemical binder. Acrylate binders are suitable for this purpose, in particular. The binder content is advantageously up to 30% by weight, preferably 2 to 25% by weight. The precise choice of binder is made according to the specific requirements of the subsequent processor. Hard binders permit high processing speeds for an impregnation, especially bituminization, whereas a soft binder provides particularly high values of tear and nail pullout resistance.

In a further embodiment, flame-retardant modified binders can be used, also.

In a further embodiment of the invention, the base material of the invention exhibits an embossed pattern of randomly distributed or regularly arranged, small-area embossments, preferably a plain-weave embossment in which the embossed area, i.e. the totality of all thin densified areas of the spunbonded web, accounts for 30 to 60%, preferably 40 to 45%, of its total area and the thickness of the densified areas of the web is at least 20%, preferably 25 to 50%, of the thickness of the undensified areas of the web. This embossed pattern is advantageously applied in the course of a calender consolidation in the case of spunbonded webs consolidated with a fusible binder. If the base inliner is end-consolidated by means of a chemical binder, the embossed pattern can likewise be impressed by means of a calender. This embossed pattern, which is applied upon both surfaces of the spunbonded web, but preferably only upon one surface of the spunbonded web, as it passes through a heated calender, comprises a multiplicity of small embossments which are 0.2 to 40 mm$^2$, preferably 0.2 to 10 mm$^2$, in size and are separated from one another by unembossed aerial elements of the web which are located in between and of roughly the same size. The determination of the total area of the densified areas of the web and of the total area of the undensified areas of the web can be effected by means of cross-sectional micrographs, for example.

The base inliners of this invention can be combined with further textile sheet materials, so that their properties can be varied. Such composites as comprise the base inliner of the invention likewise form part of the subject-matter of this invention.

The reinforcement can be provided before, during and/or after the formation of the textile sheet.

The production of the base inliner of the invention involves the conventional measures of a) forming a textile sheet material,
b) providing the monofilament reinforcement,
c) optionally providing a further textile sheet material so that the monofilaments are surrounded by textile sheet materials in sandwich fashion,
d) consolidating the base inliner obtained as per measure c),
e) optionally impregnating the base inliner consolidated as per d) with a binder, and
f) optionally consolidating the intermediate obtained as per d) by means of elevated temperature and/or pressure, in which process the order of steps a) and b) may also be reversed.

The process of this invention comprises performing the providing of the monofilaments and each thermal treatment in the base inliner production process under tension, preferably under longitudinal tension. A thermal treatment under tension is present when the position of the monofilaments in the base inliner remains unchanged during a thermal step; of particular interest is the preservation of the longitudinal ends through application of a longitudinal tension. The textile sheet material is formed on monofilaments arriving under tension, or the monofilaments can arrive during the sheet-forming process, for example in the course of the formation of the web, leading to the textile sheet, or a textile sheet material can be formed and be joined to a reinforcement in the form of monofilaments by subsequent assembling. The joining of the textile sheet material to the reinforcement can be effected by means of conventional measures, for example by needling or adhering including fusible adhering. The advantages of the process are particularly manifest in the production of needled base inliners.

The formation of a textile sheet material as per a) can be effected by spunbond formation by means of conventional spinning apparatus.

For this, the molten polymer is fed through a plurality of consecutive rows of spinnerets, or groups of spinneret rows are supplied with polymers. If a spunbonded web consolidated by means of a fusible binder is to be produced, polymers to form the loadbearing fiber and the fusible adhesive fibers are supplied alternately. The spun polymer streams are stretched in a conventional manner and, for example by means of a rotating impact plate, laid down on a transport belt in scattered texture.

Preference is similarly given to a web laydown onto the reinforcement or to a subsequent formation of a layer from reinforcement and nonwoven by assembling.

To meet special requirements, for example fire protection or extreme thermomechanical stress, the base inliners of the invention can be combined with further components to form multilayered composite materials. Examples of further components are glass webs, thermoplastic films, metallic foils, insulants, etc.

The base inliners of the invention are useful for producing bituminized roofing and sealing membranes. This likewise forms part of the subject-matter of the present invention. To this end, the base material is treated with bitumen in a conventional manner and then optionally besprinkled with a granular material, for example with sand. The roofing and sealing membranes produced in this way are notable for good processibility. The bituminized membranes comprise at least one above-described base material embedded in a bitumen matrix, the weight of the bitumen preferably accounting for 40 to 90% by weight of the basis weight of the bituminized roofing membrane and the spunbonded web for 10 to 60% by weight. The contemplated membranes also include roofing underfelts.

Instead of bitumen it is also possible to use some other material, for example polyethylene or polyvinyl chloride, to coat the base inliner of the invention.

EXAMPLE 1

Polyethylene terephthalate (PET) ends are produced with a filament linear density of 4 dtex and laid down to form a random web 2 m in width. During laydown, steel wires are continuously provided in the longitudinal direction with a spacing of 2 cm (50 wires/m). The wires (from Bekaert) are supplied on spools and have a diameter of 0.18 mm, a strength of 2300 N/mm$^2$ and a breaking extension of 1.5%.

The web/wires composite is needled together with 40 stitches/cm$^2$ to a penetration depth of 12.5 mm using needles of the type Foster 15×18×38×3 CB and then impregnated with an acrylate binder whose weight proportion is 20% in the finished web. The binder is cured in a perforated drum oven at 210° C. This affords a reinforced web having a basis weight of 190 g/m$^2$.

The load at stated elongation values of the web were measured at ambient temperature (20° C.) with and without reinforcement, with the following results:

| Elongation % | Web without reinforcement (N/5 cm) | Web with reinforcement (N/5 cm) |
|---|---|---|
| 0.6 | 100 | 159 |
| 0.8 | 129 | 208 |
| 1.0 | 170 | 266 |
| 1.2 | 191 | 302 |
| 1.4 | 210 | 332 |
| 1.6 | 230 | 240 |
| 1.8 | 240 | 245 |
| 2 | 252 | 255 |
| 4 | 305 | 305 |
| 6 | 337 | 340 |

EXAMPLE 2

Polyethylene terephthalate (PET) ends are produced with a filament linear density of 4 dtex and laid down to form a random web 1 m in width. During laydown, steel wires (No. 1.4301) are continuously provided in the longitudinal direction with a spacing of 6.7 mm (150 wires/m). The wires (from Sprint Metal) are supplied on spools and have a diameter of 0.15 mm, a strength of 14 N and a breaking extension of 34%.

The web/wires composite is needled together with 40 stitches/cm$^2$ to a penetration depth of 12.5 mm using needles of the type Foster 15×18×38×3 CB and then impregnated with an acrylate binder whose weight proportion is 20% in the finished web. The binder is cured in a perforated drum oven at 210° C. This affords a reinforced web having a basis weight of 165 g/m$^2$.

The load at stated elongation values of the web were measured at ambient temperature (20° C.) with and without reinforcement, with the following results:

| Elongation % | Web without reinforcement (N/5 cm) | Web with reinforcement (N/5 cm) |
|---|---|---|
| 0.6 | 77 | 117 |
| 1.0 | 120 | 163 |
| 1.6 | 200 | 244 |
| 2 | 220 | 266 |
| 4 | 285 | 337 |
| 6 | 330 | 388 |
| 10 | 385 | 453 |
| 15 | 440 | 518 |
| 20 | 515 | 598 |
| 25 | 577 | 664 |
| 30 | 638 | 727 |

This Example clearly shows that the web strength is improved not only in the low elongation range but also at high elongation.

EXAMPLE 3

Polyethylene terephthalate (PET) ends are produced with a filament linear density of 4 dtex and laid down to form a random web 2 m in width. During laydown, wires consisting of an alloy of type CuZn37 are continuously provided in the longitudinal direction with a spacing of 2 cm (50 wires/m). The wires (from J. G. Dahmen) are supplied on bobbins and have a diameter of 0.25 mm, a strength of 47 N and a breaking extension of 1.4%.

The web/wires composite is needled together with 40 stitches/cm$^2$ to a penetration depth of 12.5 mm using needles of the type Foster 15×18×38×3 CB and then impregnated with an acrylic binder whose weight proportion is 20% in the finished web. The binder is cured in a perforated drum oven at 210° C. This affords a reinforced web having a basis weight of 192 g/m$^2$. The load at stated elongation values of the web were measured at ambient temperature (20° C.) with and without reinforcement, with the following results:

| Elongation % | Web without reinforcement (N/5 cm) | Web with reinforcement (N/5 cm) |
|---|---|---|
| 0.6 | 100 | 160 |
| 0.8 | 129 | 203 |
| 1.0 | 170 | 257 |
| 1.2 | 191 | 287 |
| 1.4 | 210 | 310 |
| 1.6 | 230 | 235 |
| 2 | 252 | 255 |
| 4 | 305 | 300 |

EXAMPLE 4

Polyethylene terephthalate (PET) ends are produced with a filament linear density of 4 dtex and laid down to form a random web 2 m in width. During laydown, wires consisting of an alloy of type CuSn6 are continuously provided in the longitudinal direction with a spacing of 1.2 cm (83 wires/m). The wires (from J. G. Dahmen) are supplied on bobbins and have a diameter of 0.25 mm, a strength of 21 N and a breaking extension of 54%.

The web/wires composite is needled together with 40 stitches/cm$^2$ to a penetration depth of 12.5 mm using needles of the type Foster 15×18×38×3 CB and then impregnated with an acrylic binder whose weight proportion is 20% in the finished web. The binder is cured in a perforated drum oven at 210° C. This affords a reinforced web having a basis weight of 165 g/m$^2$.

The load at stated elongation values of the web were measured at ambient temperature (20° C.) with and without reinforcement, with the following results:

| Elongation % | Web without reinforcement (N/5 cm) | Web with reinforcement (N/5 cm) |
|---|---|---|
| 0.6 | 77 | 120 |
| 1.0 | 120 | 162 |
| 1.6 | 200 | 244 |
| 2 | 220 | 264 |
| 4 | 285 | 332 |
| 6 | 330 | 381 |
| 10 | 385 | 442 |
| 20 | 515 | 582 |
| 25 | 577 | 647 |
| 30 | 638 | 710 |

This Example clearly shows that the web strength is improved not only in the low elongation range but also at high elongation.

EXAMPLE 5

Polyethylene terephthalate (PET) ends are produced with a filament linear density of 4 dtex and laid down to form a random web 2 m in width. During laydown, wires consisting of an alloy of type CuZn37 are continuously provided in the longitudinal direction with a spacing of 2 cm (50 wires/m). The wires (from J. G. Dahmen) are supplied on bobbins and have a diameter of 0.25 mm, a strength of 25 N and a breaking extension of 15%.

The web/wires composite is needled together with 40 stitches/cm$^2$ to a penetration depth of 12.5 mm using needles of the type Foster 15×18×38×3 CB and then impregnated with an acrylic binder whose weight proportion is 20% in the finished web. The binder is cured in a perforated drum oven at 210° C. This affords a reinforced web having a basis weight of 160 g/m$^2$. The load at stated elongation values of the web were measured at ambient temperature (20° C.) with and without reinforcement, with the following results:

| Elongation % | Web without reinforcement (N/5 cm) | Web with reinforcement (N/5 cm) |
|---|---|---|
| 0.6 | 77 | 114 |
| 1.0 | 120 | 165 |
| 1.6 | 200 | 247 |
| 2 | 220 | 267 |
| 4 | 285 | 334 |
| 6 | 330 | 380 |
| 10 | 385 | 436 |
| 15 | 440 | 493 |

What is claimed is:

1. A base inliner comprising a textile sheet material and an intrinsically stiff reinforcement, wherein said reinforcement comprises monofilaments in the oriented state that are disposed so as to be loadbearing even at low elongation whose diameter is at least 0.1 mm and whose Young's Modulus is at least 5 Gpa wherein said monofilaments start to absorb a force and transfer it at an elongation within the range of 0 to 1% so that an applied load needed to generate an elongation of the base inliner within the range between 0 and 1% at 20° C. differs by at least 10% at at least one value of elongation within the range of 0 to 1% when compared to said base inliner without said reinforcement.

2. The base inliner of claim 1, wherein the oriented monofilaments have a diameter of 0.1 to 0.5 mm.

3. The base inliner of claim 2, wherein the oriented monofilaments have a diameter of 0.1 to 0.3 mm.

4. The base inliner of claim 1, wherein an applied load needed to generate an elongation of the base inliner within the range between 0 and 1% differs by at least 20% at at least one value of elongation within the range of 0 to 1% when compared to said base inliner without said reinforcement.

5. The base inliner of claim 1, wherein an applied load needed to generate an elongation of the base inliner within the range between 0 and 1% differs by at least 30% at at least one value of elongation within the range of 01 to 1% when compared to said base inliner without said reinforcement.

6. The base inliner of any one of claim 1, wherein the ratio of the load at a stated elongation, measured at at least one point within the range between 0 and 1%, for said inliner at room temperature (20° C.) to said base inliner at 180° C. is not more than 3.

7. The base inliner of claim 1, wherein the textile sheet material is a spunbonded web.

8. The base inliner of claim 7, wherein said spunbonded web has been consolidated mechanically, thermally and/or chemically.

9. The base inliner of claim 8, wherein said spunbonded web has been mechanically consolidated by needling, in which case the kick-up, or the sum total of kick-up and barb depth, of the needles is less than the diameter of the monofilaments.

10. The base inliner of claim 7, wherein the polyester is at least 85 mol % polyethylene terephthalate.

11. The base inliner of claim 7, wherein said spunbonded web has been consolidated by means of a fusible binder.

12. The base inliner of claim 7, wherein said spunbonded web has been consolidated by means of a chemical binder.

13. The base inliner of claim 1, wherein the basis weight of said textile sheet material is between 20 and 500 $g/m^2$.

14. The base inliner of claim 1, wherein said monofilaments have a breaking extension of 0.5 to 100%.

15. The base inliner of claim 1, characterized by a strain reserve of less than 1%.

16. The base inliner of claim 14, wherein said monofilaments consist of high-modulus aramids, high tenacity polyester monofilaments and monofilament wires composed of metals or metallic alloys.

17. The base inliner of claim 7, wherein said spunbonded polyester web has an embossed pattern.

18. A composite material comprising a base inliner as defined in claim 1.

19. A roofing or sealing membrane comprising a base inliner as defined in claim 1.

* * * * *